United States Patent [19]

Barber

[11] Patent Number: 4,836,521

[45] Date of Patent: Jun. 6, 1989

[54] WHIRLPOOL AMUSEMENT RIDE

[76] Inventor: Gerald L. Barber, 10 Whittington Ct., Greenville, S.C. 29615

[21] Appl. No.: 249,365

[22] Filed: Sep. 23, 1988

[51] Int. Cl.[4] ..... A63G 3/00

[52] U.S. Cl. ..... 272/32; 272/35; 272/56.54; 104/86

[58] Field of Search ..... 272/32, 35, 56.5 R; 104/58, 59, 69, 70, 73, 86

[56] References Cited

U.S. PATENT DOCUMENTS

| | | | |
|---|---|---|---|
| 779,464. | 1/1905 | Bruce . | |
| 891,388 | 6/1908 | Visser et al. . | |
| 920,567 | 5/1909 | Hayes . | |
| 1,186,966 | 6/1916 | Bramkamp | 272/35 |
| 1,466,963 | 9/1923 | Ridgway | 272/35 |
| 1,738,355 | 12/1929 | Cappabianco | 272/35 |
| 4,516,943 | 5/1985 | Spieldiener et al. | 272/32 X |

FOREIGN PATENT DOCUMENTS

| | | | |
|---|---|---|---|
| 64577 | 12/1913 | Austria . | |
| 370354 | 3/1923 | Fed. Rep. of Germany | 272/32 |
| 1068822 | 7/1954 | France | 272/35 |

*Primary Examiner*—David A. Scherbel
*Assistant Examiner*—Richard E. Chilcot, Jr.
*Attorney, Agent, or Firm*—Dority & Manning

[57] ABSTRACT

An amusement ride simulating traverse of the edge of a whirlpool includes a floating vehicle, a conveyor lifting the vehicle to an inclined flume, a gate retaining the vehicle at the top of a steeply inclined portion of the flume, and a circular pond in which water is rotated by jets to form a vortex. A rotatable annular member is provided to rotate around the pond. A moat in which water is circulated by jets is disposed around the outer edge of the rotatable member and leads to a loading and unloading dock for the vehicles. Stairways and an observation deck permit entrance and exit of patrons from the loading and unloading dock. The vehicles descend the steeply inclined portion of the flume and enter the rotating waters of the pond which carry the vehicle to the rotatable member and restrain the vehicle at one of a plurality of lowermost disposed restraints, which can be retracted to permit the vehicle to move up to the next highest restraint on the rotatable member. Upon retraction of the uppermost restraint, the vehicle traverses the peak of the rotatable member and starts down the outer side of the rotatable member toward its outer edge. The path of the vehicle is defined by a guide and a plurality of driven rotating surfaces disposed parallel to the guide. The rotating surfaces are driven at speeds selected to slow down the vehicle to deposit the vehicle into the moat at substantially the same speed as the water rotating in the moat.

33 Claims, 8 Drawing Sheets

WHIRLPOOL AMUSEMENT RIDE

BACKGROUND OF THE INVENTION

The present invention relates to an amusement ride, and more particularly to an amusement ride intended to give the rider the sensation of traversing a giant whirlpool.

Austrian Pat. No. 64,577 to *Rodeck* entitled Amusement Ride With Rotating Platforms discloses an amusement ride with several platforms a, b rotating and having inclined sliding surfaces c, $c^1$ on part of their peripheries and from which persons, vehicles f, etc., on the platform are thrown off under the effect of centrifugal force. Inclined surfaces c, $c^1$ are advantageously made of fabric such as cloth that is supported on a frame construction. The vehicles are wider towards the bottom and filled with sand or other ballast and include sliding rollers or balls e embedded in the bottom surface of the vehicles to facilitate sliding on the platforms. The rider can reach the vehicles or the platform via elevators, catwalks, etc. A rotating crane p can also be provided for this purpose. The outermost platform or surface is surrounded entirely or in part by a water basin z, which is to be constructed for ambulant amusement rides by spreading a waterproof material k over a scaffolding support.

German Pat. No. 370,354 to *Rodeck* discloses an amusement ride including a rotating platform a, a vehicle b capable of carrying persons, a barrier c surrounding most of platform a, a retractable roller barrier $c^1$ surrounding the remainder of platform a, and a body of water e located on the side of retractable barrier $c^1$ opposite the side on which the rotating platform is disposed. The vehicles are placed at the center of the rotating platform and move to its circumference until they reach the barrier c. The vehicles rub against the roller barrier as a result of centrifugal force. A draw-link z is guided over a roll m to permit roller barrier $c^1$ to be lifted or lowered. Rotating platform a has a declivity at its center and has a surface which ascends toward the edge so that the vehicles do not slide too suddenly toward the edge. When the vehicles b reach barrier c, the vehicles whirl as a result of centrifugal pressure around their vertical axis, the outer edge of the vehicles having been provided with ribbing for engaging against the barrier. The edge c or the retractable edge portion $c^1$ disappears to permit the vehicles to slide into water basin e located behind the lowed barrier $c^1$.

U.S. Pat. No. 779,464 to *Bruce* discloses a whirlpool amusement ride to give the riders the experience of the sensation of being in a ship caught by a whirlpool and carried round and round on a spiral track provided on an inverted cone. A circular building a is constructed of bricks. It is about 100 feet in diameter and open at the top, which is 50 feet high. Inside building a, a frame work b forms an inverted cone and carries supports c on which a road-bed is povided for rails d d. As shown in FIG. 1 of *Bruce*, the road-bed is arranged in spiral form and runs around the inverted cone down to the bottom where a central circular space j of about 20 feet in diameter is left free. Water about one foot deep fills space j. The vessel e filled with passengers is hauled up to the top of building a on a road-bed g by means of suitable machinery h, which is either steam or electric powered. The vessel has small wheels i which ride on tracks d d. Water is made to flow down on the spiral track and over same. Canvass k is provided to cover supports c and cone b and provide a surface over which water flows down. The engine of machinery h pumps the water up to the top through pipes 1, m into the pipe n, which is provided with a number of openings o through which the water is discharged onto the tracks and canvass. The vehicle is propelled under the force of gravity and guided by the tracks provided inside building a. Only one vessel is in operation in the ride at any one time. When the vessel and passengers reach the bottom of the inverted cone, they experiece a sensation as if a ship was sucked down into the depths of the ocean by the irresistible force of the water. A channel f leads from the bottom of the inverted cone outside the building where the passengers disembark and new passengers are taken on. The vessel is then hauled up to the starting point to the top of the inverted cone from where it descends again.

U.S. Pat. No. 891,388 to *Visser et al* pertains to an amusement ride in which water circulates in a prescribed channel and boats carrying riders are elevated and then caused to descend an incline. A large diameter and shallow reservoir 1 preferably defines a circular outline. A spiral wall 2 subdivides basin 1 to provide a spiral passing 3. Basin 1 and spiral wall 2 made be constructed of concrete or masonry. A tunnel 4 is constructed beneath a side portion of basin 1 and extends from the center to the outer edge and connects opposite ends of spiral passage 3. A water wheel 5 is located in tunnel 4 to ensure circulation of water thorugh the tunnel and around the spiral channel or water course. Water wheel 5 is driven to cause water to circulate from the periphery of basin 1 to the center and then outward through tunnel 4. An elevated platform 7 is located at one side of basin 1 and inclines 8 and 9 connect opposite ends of platform 7 with opposite ends of spiral passage 3. Incline 8 is a chute down which boats slide and receive an initial impetus before entering the outer end of spiral passage 3. Incline 9 returns the boats to the platform and is provided with elevating means to carry the boats upward along same. The elevating means consists of an elevating chain with bars or links connected by rods and having cogs which are adapted to engage the boats. The boats 19 are flat botton and formed with a medial channel 20 in its bottom to receive the elevating chain. Cogs located near the rear end of the boat extend into channel 20 and are adapted to be engaged by elevating cogs 16 of the elevating chain.

In U.S. Pat. No. 920,567 to *Hayes*, an amusement device comprises a hollow body 5 with a semi-ellipsoidal shape in its interior and having an inwardly-turned flange at its upper edge which is a free edge. An inner seat 6 is provided midway its width on the side of body 5. A central circular seat 14 is provided at the bottom center inside body 5. The passengers seat themselves on seat 14 initially when body 5 is stationary. Then body 5 is seat in revolution, and the passengers are moved from seat 14 under centrifugal action up the sides of body 5 and sit on seat 6 where they are sustained at approximately right angles to natural sitting posture.

None of the prior art structures gives the rider the sensation of traversing the edge of a giant whirlpool.

OBJECTS AND SUMMARY OF THE INVENTION

It is the principal object of the present invention to provide an improved amusement ride that gives the rider the sense of traversing the edge of a giant whirlpool.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, an amusement ride simulating passage out of or traversing a whirlpool comprises a rotatable member. As embodied herein, the rotatable member has a sloping surface which extends radially outwardly and terminates in an outer edge. Preferably, the rotatable member defines a disk-shaped member, and preferably a hole is defined through the center thereof so that the rotatable member defines an annular-shaped member and assumes the general appearance of a donut. The hole through the center of the rotatable member preferably surrounds a basin for containing water to form a pond. The basin has a basin bottom and a basin sidewall connected to the bottom. Preferably, the basin sidewall rises to an interior edge of an annular-shaped platform, which preferably is surrounded at least in part by a channel for containing a body of water forming a moat. The channel has a channel bottom and an interior channel sidewall. The exterior edge of the platform preferably joins with at least a portion of the interior channel sidewall.

In further accordance with the present invention, means are provided for transporting riders. As embodied herein, the rider transport means preferably includes a passenger vehicle which preferably comprises a floatable body. The passenger vehicle further preferably includes means for preventing the floatable body from tipping over when moving on water, means for seating riders, and means for restraining riders in the seating means. As embodied herein, the means for preventing the floatable body from tipping over when moving on the water preferably includes ballast disposed beneath the center of gravity of the floatable body. The means for seating riders preferably includes a contoured seat having provision for cushioning persons seated therein. The means for restraining riders in the seating means preferably includes a seat belt traversing the lap and shoulders of persons seated on the seating means. The means for restraining riders in the seating means also preferably includes a releasable handrail which has a hinge on one end thereof and a locking mechanism on the other end thereof which can be interlocked with a support rail in front of and adjacent each seating means.

The amusement ride of the present invention further includes means for depositing passenger vehicle on the rotatable member. The depositing means preferably includes a flume disposed at least in part at an elevation higher than the basin sidewalls. At least a portion of the flume is gradually inclined toward the basin bottom. At least another portion of the flume is steeply inclined toward the basin bottom. The flume has a free end disposed above the basin bottom. Water preferably is disposed in the gradually inclined portion of the flume to permit flotation of the passenger vehicle.

As embodied herein, the rotatable member preferably comprises an envelope which forms the outer skin of the rotable member. The envelope preferably is formed of sheet metal or reinforced fiberglass and defines a convex-shaped exterior surface and a concave-shaped interior surface. When the rotatable member is annular-shaped, the envelope preferably defines a closed ring and is generally annular shaped. In such embodiments, the envelope has a peak portion and a sloping inner side which meets a sloping outer side at the peak portion. The inner side extends toward the hole in the donut and has a first predetermined curvature. The outer side extends away from the hole in the donut and has a second predetermined curvature. The predetermined curvatures can be the different, the same, or mirror images of each other. The sloping inner side preferably defines a free edge extending toward the basin bottom. The sloping outer side preferably defines a free outer edge extending beyond the platform and toward the channel bottom.

In further accordance with the present invention, the rotatable member further comprises means for supporting the envelope. As embodied herein, the means for supporting the envelope preferably comprises a superstructure disposed against the concave interior surface of the envelope and secured to same by conventional means of attachment. The superstructure includes a rigid frame that preferably is formed of a plurality of rigid interconnecting braces, which are joined together in conventional fashion.

In yet further accordance with the present invention, means are provided for rotating the rotatable member and so forcing any passenger vehicle carried thereon by centrifugal force to the outer edge of the rotatable member. As embodied herein, the means for rotating the rotatable member preferably includes at least one propelling wheel carried beneath the envelope so as to engage the uuper surface of the platform. Each propelling wheel preferably comprises a rubber tire mounted on a rigid rim. The rotating means further preferably includes a drive gear connected to the propelling wheel for driving same. The drive gear is preferably carried beneath the envelope. The means for rotating the envelope yet further preferably includes a motor disposed beneath the envelope and connected to the drive gear for driving same.

In further accordance with the present invention, means are provided for powering the rotating means. As embodied herein, the means for powering the rotating means preferably includes a plurality of electric current carrying rails disposed on top of the platform. The means for powering the rotating means further preferably includes a plurality of electric current pick-ups corresponding to the rails and disposed to maintain contact with the rails and to make electric current available to the motor and other electrically powered mechanisms of the amusement ride, as explained hereinafter.

In still further accordance with the present invention, the rotatable member yet further comprises means for guiding rotational movement of the rotatable member. As embodied herein, the rotation guiding means preferably includes a plurality of rotatable guide wheels disposed beneath the envelope. At least one of the guide wheels is disposed to rotate against the interior edge of the platform. At least another of the guide wheels is preferably disposed to rotate against the exterior edge of the platform. The guide wheels are preferably suspended from the superstruture.

In further accordance with the present invention, means are provided for restraining movement of a passenger vehicle carried by the rotatable member. As embodied herein, the movement restraining means preferably includes a restraint disposed generally circumferentially on the inner side of the envelope and extending above the exterior surface of the envelope. The restraint defines a curved surface at one end thereof configured to effect restraint of the passenger vehicle.

In further accordance with the present invention, means are provided for selectively activating the restraining means for selectively controlling the movement of the passenger vehicle toward the outer edge of the rotatable member. As embodied herein, the means for selectively activating the restraining means preferably includes a slot disposed through the inner side of the envelope. The restraint extends through the slot. At least one pneumatic cylinder is connected to the restraint. Preferably, a separate pneumatic cylinder is disposed at each end of the restraint. The pneumatic cylinders are selectively retractable so as to retract the restraint through the slot to disable the ability of the restraint to restrain the passenger vehicle from traversing the rotatable member. The pneumatic cylinders can be selectively operated to extend the restraint up through the slot to be in a position to restrain the vehicle from moving toward the outer edge of the rotatable member.

In still further accordance with the present invention, means are provided for guiding the movement of passenger vehicle toward the outer edge of the rotatable member. As embodied herein, the movement guiding means preferably defines a guide extending above the exterior surface of the envelope. The guide has one end pointing toward a free edge of the sloping outer edge of the envelope. The guide is rigidly fixed to guide the passenger vehicle which butts against the guide, at speeds and forces contemplated during operation of the amusement ride of the present invention. The guide is preferably provided with cushioning means such as rubberized bumpers or air filled bumpers.

In yet further accordance with the present invention, means are provided for regulating the speed of the passenger vehicle traversing the rotatable member. As embodied herein, a means for regulating the speed of the passenger vehicle traversing the rotatable member preferably includes at least one rotatable surface extending above the exterior surface of the envelope. Preferably, a plurality of rotatable surfaces are disposed generally in a row parallel to the guide. Each rotatable surface preferably is rubberized and is disposed for frictionally engaging the bottom surface of the passenger vehicle as the vehicle moves toward the outer edge of the rotatable member. Each rotatable surface is rotatable at a predetermined speed and in a predetermined direction. Preferably, the direction of rotation is the same as the direction of rotation of the rotatable member. The rotatable surfaces rotate at a speed designed to slow down the descent of the passenger vehicle as it travels down the outer side of the envelope toward the outer edge of the rotatable member. Once the passenger vehicle reaches the moat surrounding the rotatable member, the speed of the vehicle preferably should be approximately the same as the speed of the water circulating in the moat. This ensures a smooth landing of the vehicle onto the moat.

In futher accordance with the present invention, the speed regulating means further includes means for driving each rotatable surface in the predetermined direction and at the predetermined speed. As embodied herein, the means for driving each rotatable surface preferably includes a drive gear motor connected to each rotatable surface to drive same. Each drive gear motor is cotrollable as to its speed by a control mechanism to be described hereinafter.

The amusement ride of the present invention further includes means for sensing passage of the passenger vehicle exiting the free end of the flume. As embodied herein, the means for sensing passage of the passenger vehicle exiting the free end of the flume preferably comprises a photoelectric eye disposed at the very end of the free edge of the flume. As the vehicle passes through the light beam of the eye, it transmits a signal indicating that the passenger vehicle has exited the free end of flume. In alternative embodiments, mechanical means such as a mechanical trip also can be employed as the passage sensing means.

In further accordance with the present invention, means are provided for retaining the passenger vehicle at the top of the steeply inclined portion of the flume. As embodied herein, the flume retaining means preferably includes a mechanical gate disposed across the flume at the beginning of the steeply inclined portion of the flume. The gate can be manipulated by hand or activated machanically to move out of the way of the next passenger vehicle to be permitted to slide down the steeply inclined portion of the flume. Preferably, the gate is adapted to release the passenger vehicle only in response to receiving a signal from the passage sensing means. Thus, the passenger vehicle will not be permitted to begin its descent down the steeply incline portion of flume until the previously descending passenger vehicle has cleared the free end of the flume.

In yet further accordance with the present invention, means are provided for detecting the speed and position of the rotatable member. As embodied herein, the speed and position detecting means for the rotatable member preferably includes a mechanically actuated trip device disposed beneath the envelope. The trip device has a tripping lever carried on the envelope and preferably disposed from the superstructure. A contact bar is disposed on the platform to be contacted by the tripping lever each time the rotatable member passes. A signal proportional to the speed and position being detected by the trip device is generated as the tripping lever contacts the contact bar during each complete rotation by the rotatable member around the platform.

The amusement ride of the present invention further includes means for imparting rotational motion to water confined within the basin. As embodied herein, the means for imparting rotational motion to water confined in the basin preferably includes a plurality of water nozzles disposed on the basin bottom and the basin sidewall. Each water nozzle is supplied with water by a water pump which can be housed for example in a chamber disposed beneath the platform. The pump also can be housed outside of the channel. An inlet of the pump communicates with the basin to receive water contained therein. An outlet of the pump is connected to supply each of the inlets of the nozzles, which in turn have outlets disposed to discharge a jet of water into the basin. The discharging jets swirl the water in the pond contained by the basin in the same direction as the direction of rotation of the rotatable member.

In still further accordance with the present invention, means are provided for receiving the passenger vehicle from the outer edge of the rotatable member and returning the vehicle to the means for depositing the vehicle on the rotatable member. As embodied herein, the receiving and returning means preferably include the channel containing a body of water forming a moat, means for imparting motion to the moat, and means for conveying the passenger vehicle from the moat to the flume.

Conventional means are provided for conveying the passenger vehicle from the moat in the channel to the flume. Typically, the conveying means will include a linkage attached to the passenger vehicle, a conveyor extending from the channel to the flume, and a plurality of couplings carried by the conveyor and securable to the linkage on the passenger vehicle. The conveyor is movable in an endless loop from the channel to the flume and lifts the passenger vehicle from the channel to the flume upon engagement between the coupling of the conveyor and the linkage on the passenger vehicle. Once the passenger vehicle reaches the flume, the coupling automatically disengages from the linkage on the passenger vehicle, and the passenger vehicle floats on the water that is pumped to the flume. The incline of the flume toward its free end transports the passenger vehicle under the influence of gravity to a flume gate to be described hereinafter.

The amusement ride of the present invention further includes means for imparting rotational motion to water confined within the channel. As embodied herein, the means for importing rotational motion to water confined in the channel preferably includes a plurality of water nozzles disposed on the channel bottom and the channel sidewall. Each water nozzle is supplied with water by a water pump which can be the same or different than the pump supplying the nozzles in the basin. An inlet of the pump communicates with the channel to receive water contained therein. An outlet of the pump is connected to supply each of the inlets of the nozzle disposed to discharge a jet of water into the channel. The discharging jets propel the water in the moat contained by the channel in the same direction as the direction of rotation of the rotatable member.

In a preferred embodiment of the present invention, a human operator can control the timing of the release of the passenger vehicle. The operator observes the ride in a steady state of operation regarding the speed of the rotatable member and the velocity of water flowing in the pond contained by the basin. The operator then sights the passage of a particular point on the envelope and actuates release of the passenger vehicle according to passage of such point. The operator observes whether the vehicle so released is received by the curved surface of a restraint disposed lowermost on the envelope. The process is repeated until the particutar point on the envelope has been chosen is such that the released vehicle is safely engaged at the curved surface of the lowermost restraint in the envelope.

In an alternative embodiment, the amusement ride of the present invention further includes means for timing the release of the flume retaining means so as to direct the passenger vehicle to a predetermined location on the rotatable member. As embodied herein, the timing release means preferably includes an electronic central processing unit which receives signals from the means for sensing passage of the passenger vehicle. These signals indicate that a vehicle has exited the free end of the flume. The processor further is connected to control activation of the flume retaining means. The processor receives signals from the speed and position detecting means of the rotatable member. The processor is programmed to predict the amount of time it takes the vehicle to descend to the exit of the flume once the processor has activated the release mechanism of the flume retaining means. The processor also is programmed to release the vehicle so that it will arrive at the curved surface of the lowermost restraint and be engaged thereby. The processor can further be programmed to function as a control mechanism which controls the speed of the drive gear motors of the rotatable surfaces and the speed of the motor for the drive gear of the propelling wheel of the rotatable member.

In a preferred embodiment of the present invention, means are provided to provide water to the sloping surface of the rotatable member. As embodied herein, the rotatable member further comprises a plurality of jets carried by the envelope, a water pump carried beneath the interior surface of the envelop, and a water intake disposed beneath the envelope so as to extend beneath the surface of water contained in either the basin or the channel. The water intake communicates with an inlet of the water pump and supplies water to the inlet. An outlet of the water pump communicates with each inlet of each of the plurality of water jets carried by the envelope. The water pump supplies water to the jets on the envelope. The jets can be adjustable to regulate the amount and velocity of water exiting therefrom depending upon the flow and pressure of water supplied to each jet inlet by the water pump.

The accompanying drawings, which are incorporated in and constitute a part of this specification, illustrate exemplary embodiments of the invention and, together with the description, serve of explain the principles of the invention.

DETAILED DESCRIPTION OF THE PREFERRED EMBODIMENTS

Reference now will be made in detail to the present preferred embodiments of the present invention, examples of which are illustrated in the accompanying drawings.

Figure 1:
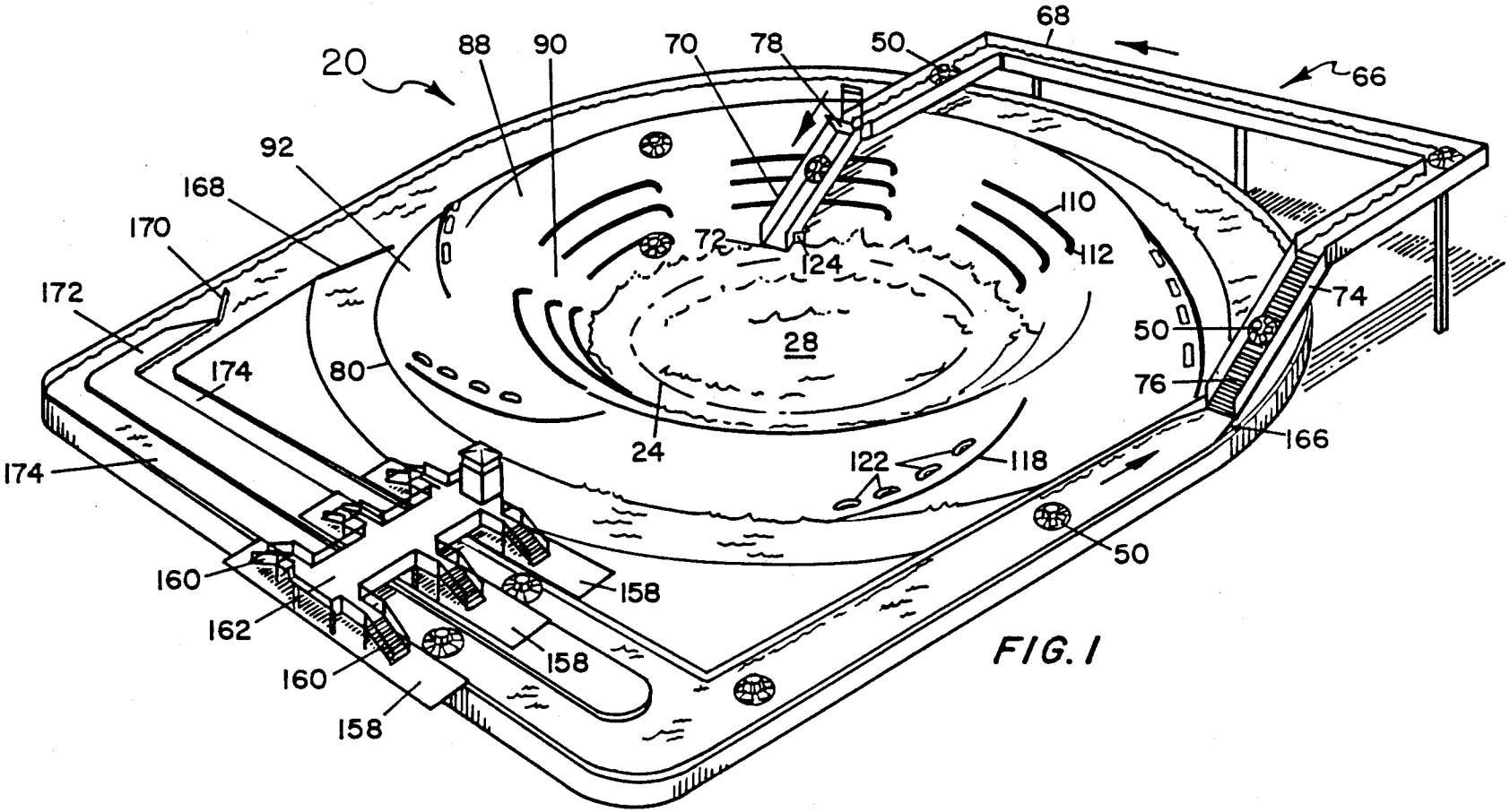
FIG. 1 is a elevated perspective view of a preferred embodiment of the present invention.

A preferred embodiment of the amusement ride according to the present invention is shown in FIG. 1 and is repesented generally by the numeral 20.

Figure 6:
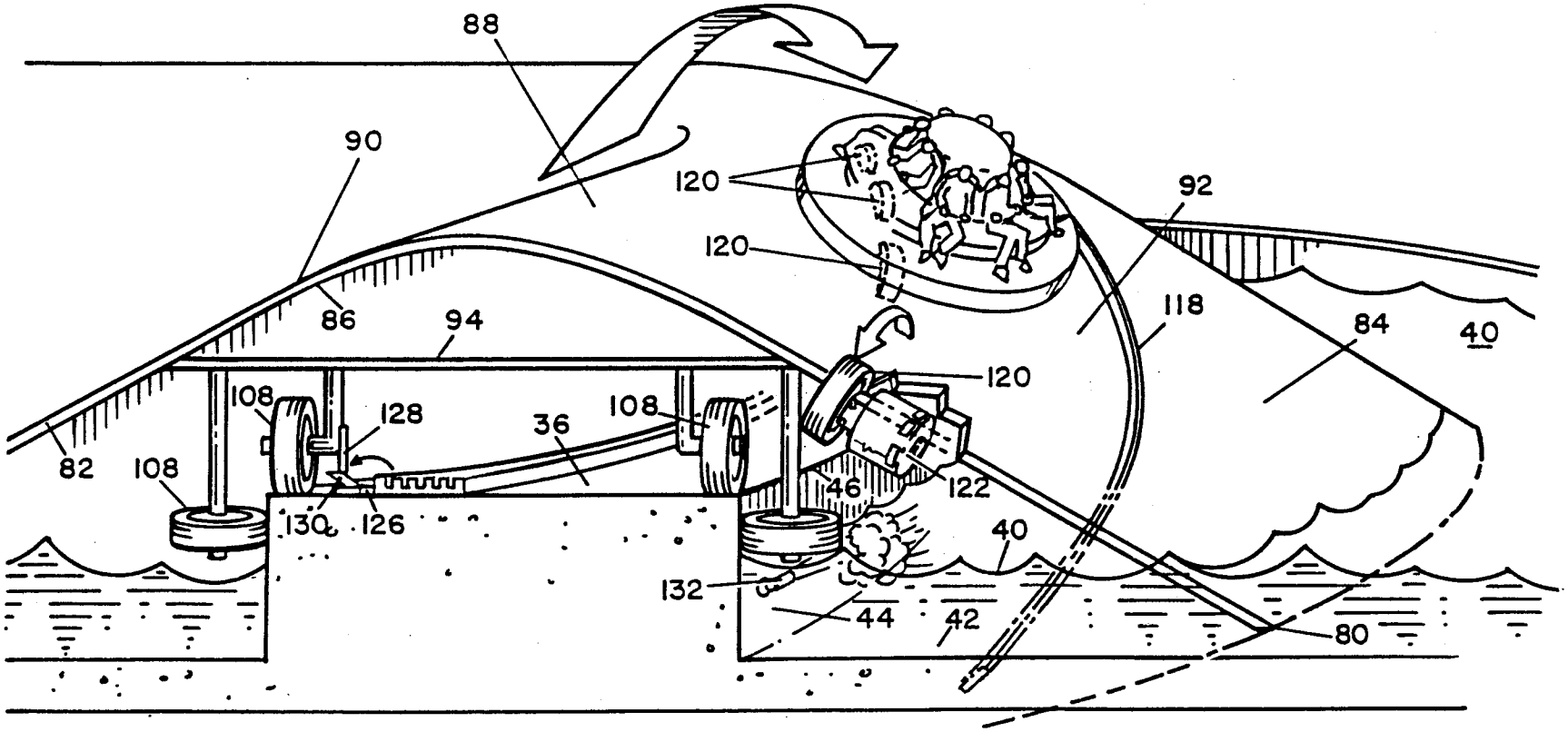
FIG. 6 is a perspective cut-away view of components of a perferred embodiment of the present invention.
Figure 7:
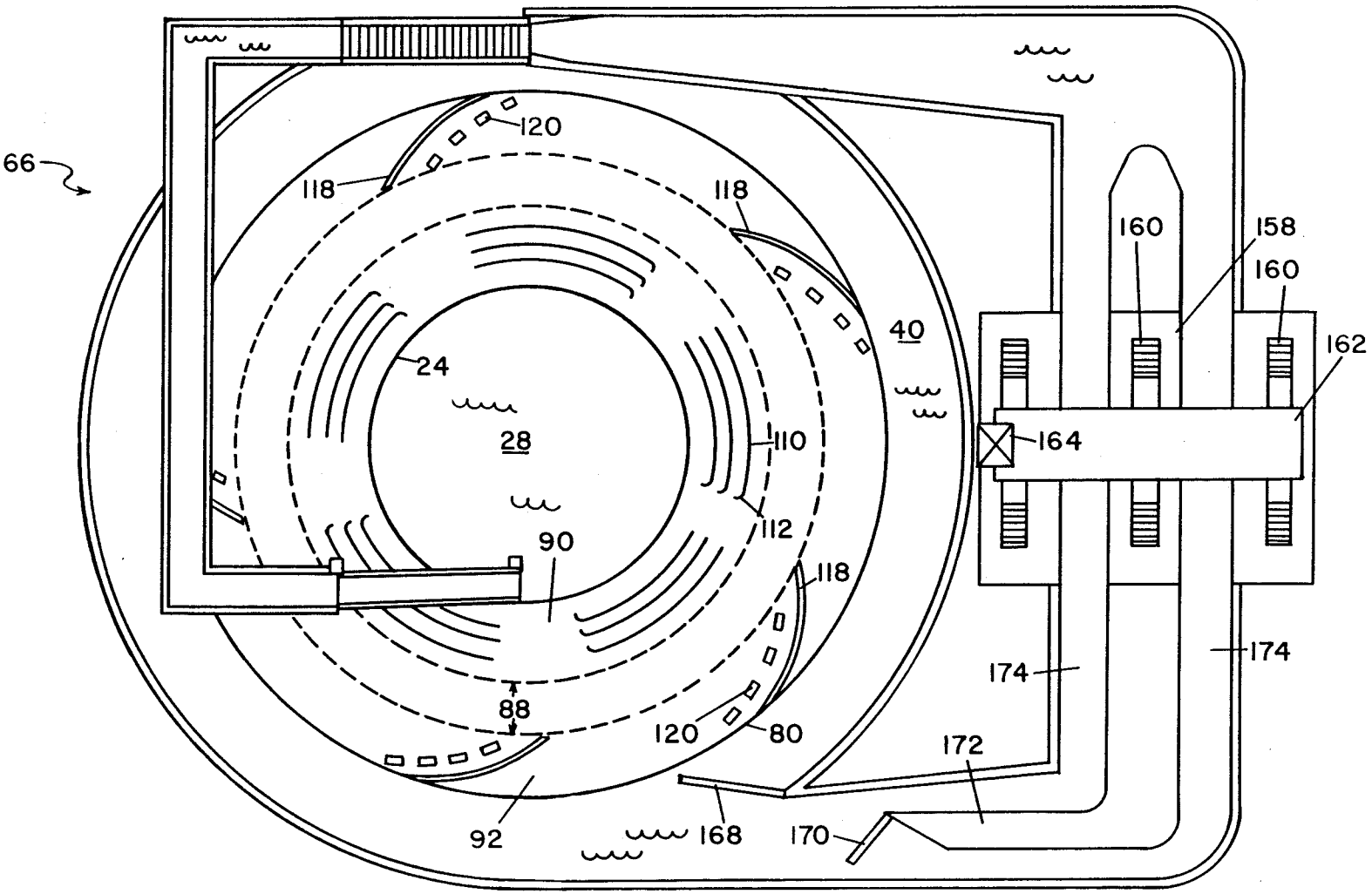
FIG. 7 is a top plan view of the preferred embodiment of the present invention shown in FIG. 1.

In accordance with the present invention, an amusement ride simulating passage out of or traversing a whirlpool comprises a rotatable member. As embodied herein and shown in FIG. 2 for example, the rotatable member has a sloping surface 22 which extends radially outwardly and terminates in an outer edge 80. Perferably, the rotatable member defines a disk-shaped member. As shown in FIGS. 1 and 7 for example, preferably a hole 24 is defined through the center of the rotatable disk-shaped member so that the rotatable member assumes the general appearance of a donut. As shown for example in FIG. 2, the hole through the center of the rotatable member preferably surrounds a basin 26 for containing water to form a pond 28. The basin has a basin bottom 30 and a basin sidewall 32 connected to the bottom. Preferably, as shown for example in FIG. 2, the basin sidewall rises to an interior edge 34 of an annular-shaped platform 36, whcih preferably is surrounded by a channel 38 for containing a body of water forming a moat 40. At least part of the channel surrounds the platform and has a channel bottom 42 and an interior channel sidewall 44. As shown for example in FIG. 6, the exterior edge 46 of the platform preferably joins with at least a portion, and preferably all of, the interior channel sidewall 44.

Figure 9:
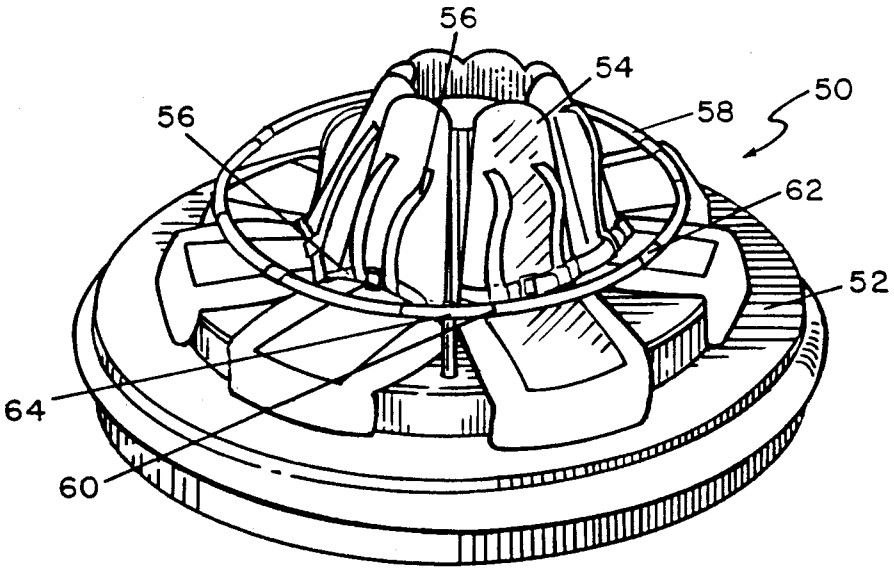
FIG. 9 is an elevated perspective view of a componet of a preferred embodiment of the present invention.

In further accordance with the present invention, means are provided for transporting rides. As embodied herein and shown for example in FIG. 9, the rider transport means preferably includes a passenger vehicle designated generally by the numberal 50. Vehicle 50 preferably comprises a floatable body 52, means for preventing the floatable body tipping over when moving on water, means for seating riders, and means for restraining riders in the seating means. As embodied herein shown for example in FIG. 9, the means for preventing the floatable body from tipping over when moving on the water preferably includes ballast disposed beneath the center of gravity of floatable body 52. A heavy weight (not shown) serves as suitable ballast. The means for seating rides preferably includes a contoured seat 54 having provision for cushioning persons seated therein. The means for restraining riders in the seating means preferably includes a seat belt 56 traversing the lap horizontally and extending vertically across the shoulders of each person seated on the seating means. The means for restraining riders in the seating means also preferably includes a releasable handrail 58 which has a hinge 60 on one end thereof and a locking mechanism 62 on the other end thereof which can be interlocked with a support rail 64 in front of and adjacent each seating means. The riders can grasp the handrail to give them something to hold.

The amusement ride of the present invention further includes means for depositing a passenger vehicle on the rotatable member. As embodied herein and shown in FIG. 1 for example, the depositing means preferably includes a flume designated generally by the numeral 66. Flume 66 is disposed at least in part at an elevation higher than basin sidewall 32. At least a portion 68 of flume 66 is gradually inclined toward basin bottom 30. At least another portion 70 of the flume is steeply inclined toward basin bottom 30. As shown for example in FIG. 1, flume 66 has a free end 72 disposed above basin bottom 30. Water is disposed in gradually inclined portion 68 of the flume to permit flotation of passenger vehicle 50.

The depositing means preferably further includes means for imparting rotational motion to water confined within the basin.

Figure 2:
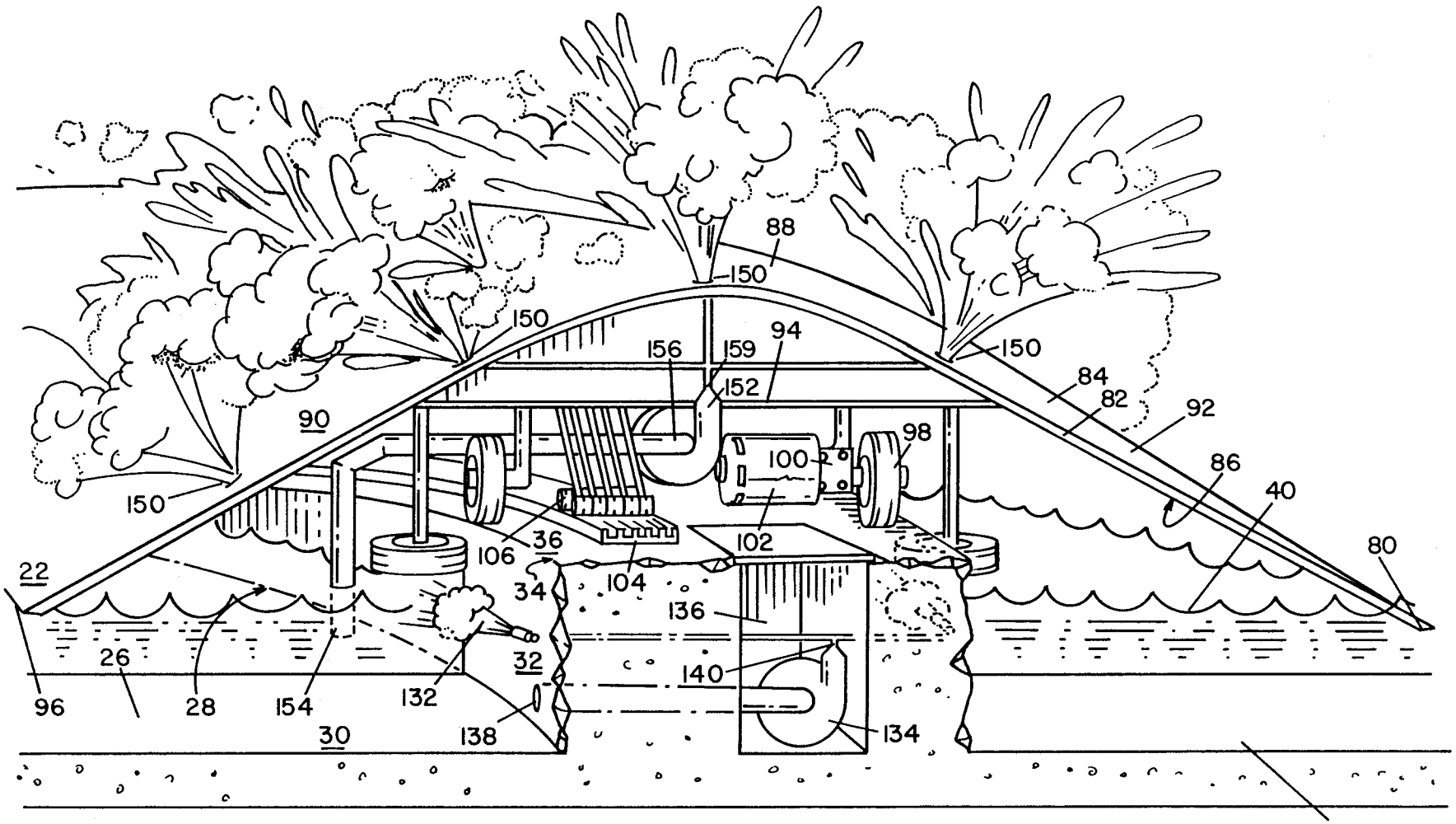
FIG. 2 is a perspective cut-away view of components of a preferred embodiment of the present invention.

As embodied herein and shown in FIG. 2 for example, the means for imparting rotational motion to water confined in the basin preferably includes a plurality of water nozzles 132 disposed on basin bottom 30 and basin sidewall 32. Each nozzle is supplied with water by a water pump 134 which can be housed in a chamber 136 disposed beneath platform 36. An inlet 138 of pump 134 communicates with the basin to receive water from pond 28 contained therein. An outlet 140 of pump is connected to supply each of the inlets of nozzles which in turn have jet outlets disposed to discharge a jet stream of water into basin 26 in a direction that is the same as the direction of rotation of the rotatable member.

Conventional means are provided for conveying the passenger vehicle from the channel to the flume. Typically, the conveying means will include a linkage (not shown) attached to the passenger vehicle, a conveyor 74 extending from the channel to the flume, and a plurality of couplings 76 carried by the conveyor and securable to the linkage on the vehicle. As shown for example in FIG. 1, the conveyor is movable in an endless loop from the channel to the flume and lifts the vehicle from the channel to the flume upon engagement between the coupling of the conveyor and the linkage on the vehicle. Once the vehicle reaches the flume, the coupling automatically disengages fron the linkage on the passenger vehicle, and the passenger vehicle floats on the water that is pumped to the flume by conventional means. As shown in FIG. 1, the incline of the gradually inclined portion 68 of flume 66, transports the passenger vehicle under the influence of gravity to a flume gate 78 to be described hereafter.

In still further accordance with the present invention, means are provided for receiving the passenger vehicle from the outer edge 80 of the rotatable member and returning the vehicle to the means for depositing the vehicle on the rotatable member. As embodied herein, the receiving and returning means preferably includes channel 38 containing a body of water forming moat 40 and the previously described means for conveying the passenger vehicle from the moat to the flume.

The receiving and returning means of the present invention further includes means for imparting rotational motion to water confined within the channel. As embodied herein and shown in FIG. 6 for example, the means for imparting rotational motion to water confined in the channel preferably includes a plurality of nozzles 132 disposed on or in channel bottom 42 and channel sidewall 44. Each nozzle is supplied with water by a water pump (not shown) which can be housed in a chamber disposed beneath platform 36. An inlet of the pump communicates with the channel to receive water contained therein. An outlet of the pump is connected to supply each of the inlets of the nozzles disposed to discharge a jet stream of water into channel 38 in the same direction as the direction of rotation of the rotatable member.

In further accordance with the present invention, a rotatable member is provided for simulating the outermost free edge of a whirlpool. As embodied herein and shown for example in FIGS. 2–6, the rotatable member preferably comprises an envelope 82 which forms the outer skin of the rotatable member. Envelope 82 preferably defines a closed ring and is generally annular-shape around a hole 24 as shown for example in FIGS. 1 and 7. Envelope 82 preferably defines a sloping surface 22 which includes a convex-shaped exterior surface 84 and a concave-shaped interior surface 86. Envelope 82 has a peak portion 88 and a sloping inner side 90 which meets a sloping outer side 92 at peak portion 88. As shown in FIGS. 2–6, an end view of a cross section of envelope preferably has the shape of a mountain peak. Inner side 90 has a first predetermined curvature. Outer side 92 has a second predetermined curvature, but the predetermined curvature of inner side 90 can be the same as the predetermined curvature of outer side 92 in some embodiments. The predetermined curvatures of inner side 90 and outer side 92 also can be mirror images of each other in some embodiments. Envelope 82 preferably is formed of sheet metal or reinforced fiberglass.

In further accordance with the present invention, the rotatable member further comprises means for supporting the envelope. As embodied herein and shown for example in FIGS. 2-6 , the means for supporting the envelope preferably comprises a superstructure 94 disposed against concave interior surface of envelope 82 and secured to same by conventional means of attachment. Superstructure 94 preferably is formed of a plurality of rigid interconnecting braces, which are joined together in conventional fashion. As shown in FIG. 2 for example, sloping inner side 90 preferably defines a free edge 96 extending toward the basin bottom. Sloping outer side 92 preferably defines a free outer edge 80 extending radially outwardly.

In yet further accordance with the present invention, the rotatable member further comprises means for rotating the rotatable member and so forcing any passenger vehicle carried thereon by centrifugal force to the outlet edge of the rotatable member. As embodied herein and shown in FIG. 2 for example, the means for rotating the rotatable member preferably includes at least one propelling wheel 98 carried beneath envelope 82 so as to engage the upper surface of the platform. Each propelling wheel 98 preferably comprises a rubber tire mounted on a rigid rim. The rotating means further preferably includes a drive gear 100 connected to the rim for driving the propelling wheel 98. Drive gear 100 is preferably carried beneath envelope 82. The means for rotating the rotatable member yet further preferably includes a motor 102 disposed beneath envelope 82 and connected to drive gear 100 for driving same.

In further accordance with the present invention, means are provided for powering the rotating means. As embodied herein and shown for example in FIG. 2, a means for powering the rotating means preferably includes a plurality of electric current carrying rails 104 disposed on top of platform 36. Conventionally, rails 104 carry three-phase alternating electric current. The means for powering the rotating means further preferably includes a plurality of electric current pick-ups 106 corresponding to rails 104 and disposed to maintain contact with rails 104 and to make electric current available to motor 102 and other electrically powered mechanisms of the amusement ride.

In further accordance with the present invention, the rotatable member yet further comprises means for guiding rotational movement of the rotatable member. As embodied herein and shown in FIGS. 2-6 for example, the rotation guiding means preferably includes a plurality of rotatable guide wheels 108 disposed beneath envelope 82. At least one of guide wheels 108 is disposed to rotate aganist interior edge 34 of platform 36. At least another one of guide wheels 108 is preferably disposed to rotate against exterior edge 46 of platform 36. Guide wheels 108 are preferably suspended from superstructure 94 and disposed to rotate against basin sidewall 32 and channel sidewall 44.

In further accordance with the present invention, the rotatable member further comprises at least one means for restraining a passenger vehicle from traversing the rotatable member. As embodied herein and shown for example in FIGS. 1, 3-5, and 7, the means for restraining the passenger vehicle from traversing, i.e., moving across, the rotatable member preferably includes a restraint 110 disposed on the inner side of envelope 82 and extending above sloping surface 22 of envelope 82. Restraint 110 defines a curved surface 112 at one end thereof having a curvature corresponding to the curvature of the passenger vehicle to be restrained thereby. Restraint 110 preferably is formed of steel or other material suited to carry out the function performed by restraint 110.

In further accordance with the present invention the rotatable member further includes means for selectively activating the restraining means for selectively controlling the movement of the passenger vehicle toward the outer edge of the roatable member. As embodied herein and shown for example in FIGS. 3-5, the means for selectively activating the restraining means preferably includes a slot 114 disposed through inner side 90 of envelope. 82. Restraint 110 extends through slot 114. At least one pneumatic cylinder 116 is connected to restraint 110. Preferably, a separate pneumatic cylinder 116 is disposed at each end of the restraint. The pneumatic cylinders are selectively retractable so as to retract restraint 110 through slot 114 and beneath sloping surface 22 of envelope 82 to disable the ability of restraint 110 to restrain the passenger vehicle from traversing the rotatable member. The pneumatic cylinders can be operated to extend the restraint up through slot 114 to be in a position to restrain the vehicle from moving toward outer edge 80 of the rotatable member. Preferably, an air compressor (not shown) is carried beneath envelope 82 and mounted to superstructure 94 to supply pressurized air to operate pneumatic cylinders 116.

In still further accordance with the present invention, the rotatable member further comprises means for guiding the movement of the passenger vehicle toward the outer edge of the rotatable member. As embodied herein and shown for example in FIGS. 1, 6, and 7, the movement guiding means preferably defines a guide 118 extending above exterior surface 22 of envelope 82. Guide 118 has one end pointing toward outer edge 80 and an opposite end pointing toward envelope peak 88. Rather than extending strictly in a radial direction or strictly in a circumferential direction, each guide 118 extends in a direction that is generally intermediate the radial and circumferential directions. Guide 118 is rigidly fixed to guide passenger vehicle 50 butting aginst guide 118 at speeds and forces contemplated during operation of the amusement ride of the present invention. Guide 118 is preferably formed of steel and is preferably provided with cushioning means such as rubberized bumpers or air filled bumpers to cushion the impact of the vehicles against guide 118.

In yet further accordance with the present invention, the rotatable member yet further comprises means for regulating the speed of the passenger vehicle moving across, i.e., traversing, the rotatable member. As embodied herein and shown in FIGS. 6 and 7 for example, a means for regulating the speed of passenger vehicle 50 traversing the rotatable member preferably includes at least one rotatable surface 120 extending above sloping surface 22 of envelope 82. Preferably, a plurality of rotatable surfaces 120 are disposed generally in a row parallel to guide 118. Each rotatable surface 120 preferably is rubberized and is disposed for frictionally engaging the bottom surface of the passenger vehicle as the passenger vehicle movers towed outer edge 80 of the rotatable member. As shown for example in FIG. 6, the placement of rotatable surfaces is such that when vehicle 50 rest against guide 118, rotatable surface 120 engages vehicle 50 so that the center of vehicle 50 is disposed between guide 118 and the rotatable surface 120. Each rotatable surface 120 is rotatable at a predetermined speed and in a predetermined direction. Perferavly, the direction of rotation is the same as the direction of rotation of the rotatable member. However, th espeed of each rotatable surface is progressively less from one to another progresses from rotatable surfaces closest to peak 88 to the rotatable surface closest to free outer edge 80 of the rotatable member. The plurality of progressively slower rotatable surface are designed to slow down the descent of the passenger vehicle as it travels down outer side 92 of envelope 82. Once the passenger vehicle reaches the moat surrounding the rotatable member, the speed of the vehicle should be approximately the same as that of the water moving in the moat.

In further accordance with the present invention, the speed regulating means further includes means for driving each rotatable surface in the predetermined direction and at the predetermined speed. As embodied herein and shown in FIG. 6 for example, the means for driving each rotatable surface preferably includes a drive gear motor 122 connected to each rotatable surface to drive same. Each drive gear motor 122 is powered by electricity and controllable as to its speed by a control mechanism to be described hereinafter.

The amusement ride of the present invention further includes means for sensing passage of the passenger vehicle exiting the free end of the flume. As embodied herein and shown in FIG. 1 for example, the means for sensing passage of the passenger vehicle exiting the free end of the flume preferably comprises a photoelectric eye 124 disposed at the very end of the free edge of the flume. As the vehicle passes through the light beam of the eye, it transmits a signal indicating that the passenger vehicle has exited the free end of flume 66. In alternative embodiments, mechanical means such as a mechanical trip also can be employed as the passage sensing means.

In further accordance with the present invention, means are provided for retaining the passenger vehicle at the top of the steeply inclined portion of the flume. As embodied herein and shown in FIG. 1 for example, the flume retaining means preferably includes a mechanical gate 78 disposed across flume 66 at the beginning of the steeply inclined portion 70 of flume 66. Gate 78 can be manipulated by hand or activated mechanically, electrically or pneumatically to move out of the way of the next vehicle to be permitted to slide down the steeply inclined portion of flume 66. Preferably, gate 78 is adapted to release the passenger vehicle only in response to receiving a signal from the passage sensing means. Thus, a vehicle will not be permitted to begin its descent down the steeply inclined portion of flume 66 until the previously descending vehicle has cleared the bottom of the flume.

In yet further accordance with the present invention, means are provided for detecting the speed and position of the rotatable member. As embodied herein and shown in FIG. 6 for example, the speed and position detecting means for the rotatable member preferably includes a mechanically actuated trip device 126 disposed beneath the envelope. Trip device 126 has a contact bar 128 carried on envelope 82 and preferably disposed from superstructure 94. A switch plate 130 is disposed on platform 36 to be contacted by contact bar 128 each time the rotatable member passes switch plate 130. A signal proportional to the speed and position being detected by trip device 126 is generated as contact bar 128 contacts switch plate 130 during each complete rotation around platform 36 by the rotatable member. The generation of this signal provides information about when a particular point on the rotatable member has reached a particular point in the cycle of its revolution around the basin. It also provides information as to the speed of rotation around basin 26.

In a preferred embodiment of the present invention, a human operator can control the timing of the release of the passenger vehicle. The operator observes until the ride attains a steady state of operation regarding the speed of the rotatable member, the velocity of water flowing in the pond contained by the basin, and the velocity of the water flowing in the moat contained in the channel. The operator then sights the passage of a particular point on the envelope of the rotatable member and actuates release of a passenger vehicle from the retaining means at the top of the steeply inclined portion of the flume, according to passage of such point on the rotatable member. The operator observes whether the vehicle so released is received by the curved surface of a restraint positioned lowermost on the inner side of the rotatable member. The process is repeated until the timing is such that the released vehicle is safely engaged at the curved surface of a predetermined one of the lowermost restraints.

Figure 8:
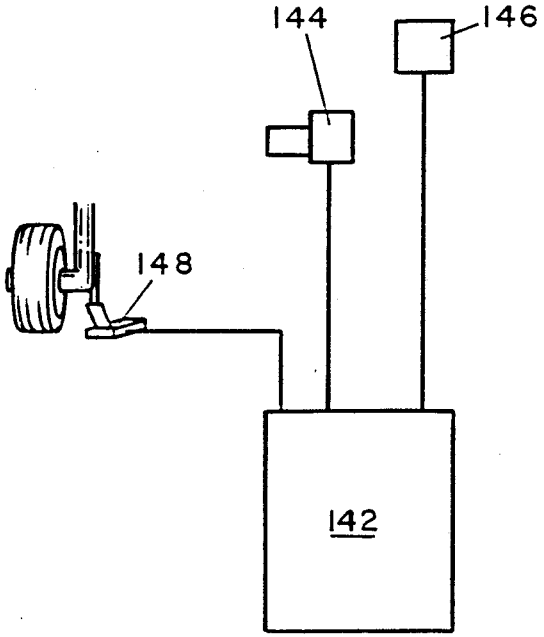
FIG. 8 is a schematic diagram of components of a preferred embodiment of the present invention.

In an alternative embodiment, the amusement ride of the present invention further includes means for timing the release of the flume retaining means so as to direct the passenger vehicle to a predetermined location of the rotatable member. The predetermined location preferably is at one of the curved surfaces of one of the lower most restraining means disposed on the inner side of the envelope. As embodied herein and shown schematically in FIG. 8 for example, the timing release means preferably includes an electronic central processing unit 142 which receives signals from the means 144 for sensing passage of the passenger vehicle. These signals indicate that a vehicle has exited the free end of flume 66. Processor 142 further is connected to control activation of the flume retaining means 146. The processor receives signals from the speed and position detecting means 148 of the rotatable member. The processor is programmed to predict the amount of time it takes the vehicle to descend to the free end of the flume once the processor has activated the release mechanism of the flume retaining means. The processor also is programmed to release the vehicle so that it will arrive at a predetermined curved surface of one of the restraints positioned lowermost on envelope 82 so as to be engaged thereby. The processor also can be connected and programmed to function as a control mechanism for the speed of the drive motor 102 of the rotatable member, the speed of the rotatable surfaces 120, and the operation of pneumatic cylinders 116 and the various water pumps.

In a preferred embodiment of the present invention shown for example in FIG. 2, the rotatable member further comprises a plurality of jets 150 carried by envelope 82, a water pump 152 carried beneath interior surface 86 of envelope 82, and a water intake 154 disposed beneath the envelope so as to extend beneath the surface of water contained in either the basin or the channel. Water intake 154 communicates with an inlet 156 of water pump 152 and supplies water to inlet 156. An outlet 159 of water pump 152 communicates with each inlet of each of the plurality of water jets carried by the rotatable member. Water pump 152 supplies water to jets 150, which can be adjustable to regulate the amount and velocity of water exiting therefrom depending upon the flow and pressure of water supplied to each jet inlet by water pump 152.

The amusement ride of the present invention is scaled according to the size which best fits the amusement park in which it is to be located. The power requirements of the various motors and pumps are then scaled accordingly, as known in the art.

Referring initially to FIG. 1, operation of a preferred embodiment of the amusement ride of the present invention proceeds as follows.

Figure 3:
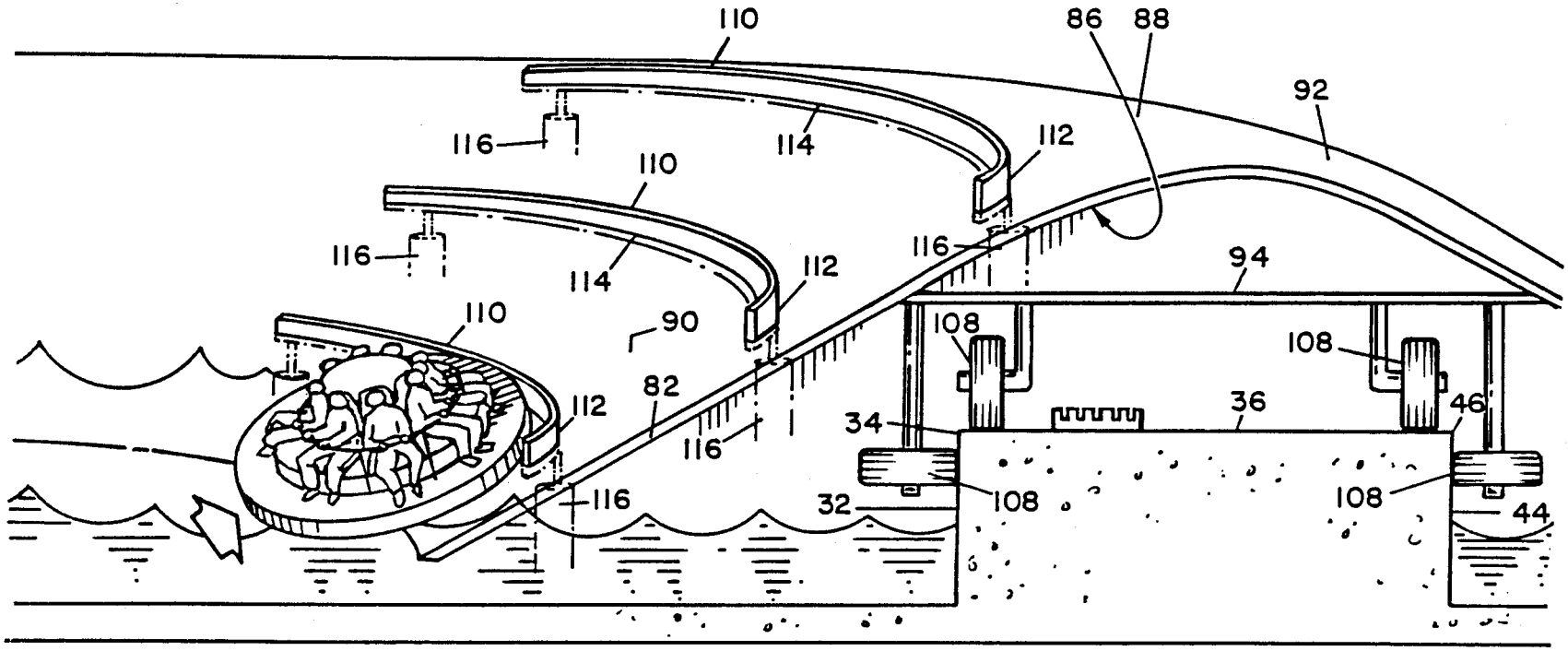
FIG. 3 is a perspective cup-away view of components of a preferred embodiment of the present invention.
Figure 4:
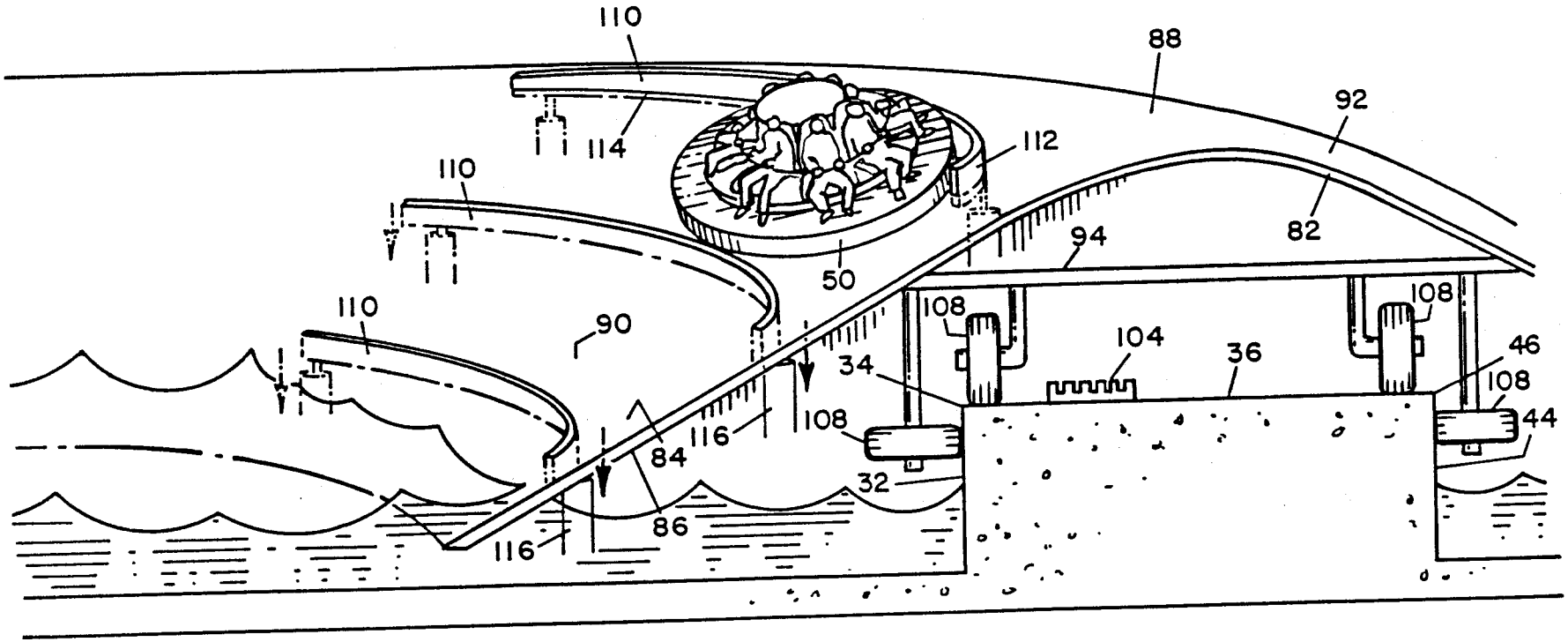
FIG. 4 is a perspective cut-away view of components of a preferred embodiment of the present invention.
Figure 5:
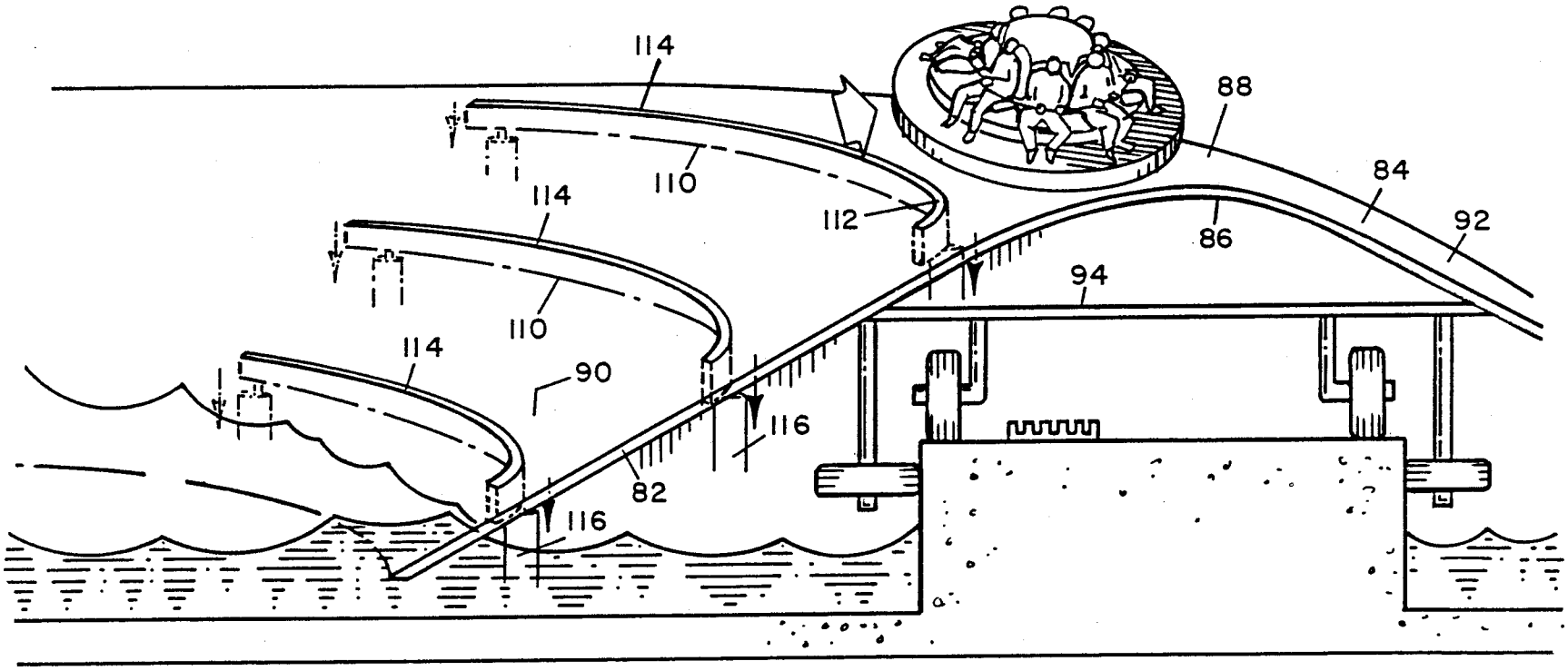
FIG. 5 is a perspective cut-away view of components of a preferred embodiment of the present invention.

Patrons of the amusement ride of the present invention access loading docks 158 via a plurality of stairways 160 attached to an observation deck 162, which also houses an operator control booth 164 preferably disposed with an unobstructed view of envelope 82. Operator control booth 164 also preferably is disposed so as to have an unobstructed view of steeply inclined portion 70 of flume 66 and retaining gate 78 thereof. Riders board vehicles 50 preferably beneath observation deck 162 from each of loading docks 158 where vehicles 50 are docked. Water nozzles propel water in the moat filling the channel so as to move vehicles 50 toward a funnel entrance 166 of conveyor 74. Vehicles 50 loaded with passengers are hauled to the top of conveyor 74 and released at the beginning of gradually inclined portion 68 of flume 66, which is filled with water so that the vehicles float down same toward gate 78 at the top of steeply inclined portion 70 of the flume. Arriving at gate 78, the vehicles are retained at the gate until released therefrom to descend steeply inclined portion 70 of the flume. The inertia of the vehicle exiting the flume and the swirling water in the pond combine to propel the vehicle onto the inner side of the rotatable member. The timing of the release of the vehicles is such as to ensure that vehicle 50 will be captured by curved surface 112 of a lowermost restraint 110 on inner side 90 of envelope 82 of the rotatable member, as shown in FIG. 3 for example. The rotatable member is rotating at approximately 20–22 miles per hour measured at outer edge 80 of envelope 82. After a predetermined number of revolutions of the rotatable member, or a fractional portion of a revolution, depending upon the length of the ride to be given to the patrons, the lowermost restraint is retracted beneath envelope 82. Whereupon the vehicle moves to the next higher restraint and is held at curved surface 112 thereof. This is repeated until the vehicle has been restrained by the highermost restraint such as shown in FIG. 4 for example. Whereupon as shown in FIG. 5 for example, the highermost restraint is also retracted under the control of the ride operator observing same from operator control booth 164. Vehicle 50 then slides across peak 88 of envelope 82 as shown for example in FIG. 5. Once across peak 88, vehicle 50 is captured by guide 118 as shown in FIG. 6, and the bottom of vehicle 50 engages rotatable surfaces 120. While rotatable surfaces 120 are driving in the same direction as movement of the rotatable member and movement of vehicle 50, rotating surfaces 120 are driven at a slower speed than movement of the rotatable member and movement of the vehicle. Thus, rotating surfaces 120 serve to slow down descent of vehicle 50 toward free outer edge 80 of envelope 82. Each successive rotating surface closer to free outer edge 80 of envelope 82 rotates at a slightly slower speed than the previous rotatable surface to effect a gradual slowing down of vehicle 50. Once the vehicle has passed over the last of rotating surfaces 120, its speed closely approximates the velocity of the water in moat 40 so that upon entering moat 40, vehicle 50 makes a smooth transition into the moat. Preferably, the ride is timed so that the vehicles will be deposited in moat 40 near the observation deck and control booth. Vehicle 50 is carried around moat 40 by water rotating therearound until vehicle 50 enters a staging area leading to loading docks 158. As shown for example in FIGS. 1 and 7, a guide bar 168 extends across channel 38 and preferably is disposed so as to be visible when channel 38 is filled with water to form moat 40. This guide bar guides vehicles 50 into the staging area leading to loading docks 158. In addition, a pivoting guide bar 170 is disposed at the end of a dividing pier 172 so as to alternate access to each staging channel 174 leading to respective loading docks 158. Passengers finishing their rides unload from the loading docks, and the empty vehicle is available to take on new passengers.

It will be apparent to those skilled in the art that various modifications and variations can be made in the present invention without departing from the scope or spirit of the invention. Thus, it is intended that the present invention cover the modifications and variations of this invention provided they come within the scope of the appended claims and their equivalents.

What is claimed is:

1. An amusement ride simulating passage out of a whirlpool comprising:

(a) a disk-shaped member;

(b) said disk-shaped member having a sloping surface which extends radially outwardly and terminates in an outer edge;

(c) a passenger vehicle supportable on said sloping surface of said disk-shaped member;

(d) means for depositing said passenger vehicle on said disk-shaped member;

(e) means for rotating said disk-shaped member and so forcing passenger vehicle by centrifugal force to said outer edge of said disk-shaped member;

(f) means for receiving said passenger vehicle from said outer edge of said disk-shaped member and returning said passenger vehicle to said means for depositing said passenger vehicle on said disk-shaped member; and (g) means for supplying water to said sloping surface.

2. The amusement ride as set forth in claim 1, further comprising:

means for restraining movement of said passenger vehicle carried by said disk-shaped member; and means for selectively activating said restraining means for selectively controlling the movement of said passenger vehicle toward said outer edge of said disk-shaped member.

3. An amusement ride simulating passage out of a whirlpool comprising:

(a) a rotatable member;

(b) said rotatable member having a sloping surface which extends radially outwardly and terminates in an outer edge;

(c) a passenger vehicle supportable on said sloping surface of said rotatable member;

(d) means for rotating said rotatable member and so forcing said passenger vehicle by centrifigural force to said outer edge of said rotatable member;

(e) means for restraining movement of said passenger vehicle when supported by said rotatable member; and (h) means for selectively activating said restraining means for selectively controlling the movement of said passenger vehicle toward said outer edge of said rotatable member.

4. An apparatus as in claim 3, wherein said rotatable member defines a disk-shaped member.

5. An apparatus as in claim 4, wherein said disk-shaped member defines a hole through the center thereof.

6. An apparatus as in claim 5, further comprising:

means for imparting rotational motion to water confined within said hole.

7. An apparatus as in claim 6, wherein:

said means for imparting rotational motion to water confined within said hole includes at least one nozzle for dispensing a jet of water therefrom, said nozzle being directed so as to discharge any water therefrom in the same direction as the direction of rotation of said rotatable member.

8. An apparatus as in claim 3, wherein said passenger vehicle includes:

(a) a floatable body;

(b) means for preventing said body from tipping over when moving on water;

(c) means for seating riders; and (d) means for restraining riders in said seating means.

9. An apparatus as in claim 3, further comprising:

(i) means for guiding the movement of said passenger vehicle toward said outer edge of said rotatable member; and (j) means for regulating the speed of said passenger vehicle moving across said rotatable member.

10. An amusement ride simulating passage out of a whirlpool comprising:

(a) a rotatable member;

(b) said rotatable member having a sloping surface which extends radially outwardly and terminates in an outer edge;

(c) a passenger vehicle supportable on said sloping surface of said rotatable member;

(d) means for depositing said passenger vehicle on said rotatable member;

(e) means for rotating said rotatable member and so forcing said passenger vehicle by centrifugal force to said outer edge of said rotatable;

(f) means for receiving said passenger vehicle from said outer edge of said rotatable member and returning said passenger vehicle to said means for depositing said passenger vehicle on said rotatable member;

(g) means for guiding the movement of said passenger vehicle toward said outer edge of said rotatable member; and (h) means for regulating the speed of said passenger vehicle moving across said rotatable member.

11. An apparatus as in claim 10, wherein said movement guiding means defines a guide extending above said rotatable member and having one end pointing toward said outer edge of said rotatable member.

12. An apparatus as in claim 11, wherein said speed regulating means includes:

(a) at least one rotatable surface extending at least partially above said rotatable member and disposed for engaging said passenger vehicle moving across said rotatable member, said rotatable surface being rotatable at a predetermined speed and in a predetermined direction; and (b) means for driving each said rotatable surface in said predetermined direction and at said predetermined speed.

13. An apparatus as in claim 12, wherein:

said means for driving each said rotatable surface includes a drive gear motor connected to said rotatable surface and carried by said rotatable member.

14. An apparatus as in claim 12, further including a plurality of said rotatable surfaces further disposed generally in a row parallel to said movement guiding means.

15. An amusement ride simulating passage out of a whirlpool comprising:

(a) a rotatable member;

(b) said rotatable member having a sloping surface which extends radially outwardly and terminates in an outer edge;

(c) a passenger vehicle supportable on said sloping surface of said rotatable member;

(d) means for depositing said passenger vehicle on said rotatable member;

(e) means for rotating said rotatable member and so forcing said passenger vehicle by centrifugal force to said outer edge of said rotatable member;

(f) means for receiving said passenger vehicle from said outer edge of said rotatable member and returning said passenger vehicle to said means for depositing said passenger vehicle on said rotatable member;

(g) means for restraining movement of said passenger vehicle carried by said rotatable member;

(h) means for selectively activating said restraining means for selectively controlling the movement of said passenger vehicle toward said outer edge of said rotatable member;

(i) means for supplying water to said sloping surface;

(j) means for guiding the movement of said passenger vehicle toward said outer edge of said rotatable member; and (k) means for regulating the speed of said passenger vehicle moving across said rotatable member.

16. An apparatus as in claim 15, wherein said means for supplying water to said sloping surface includes;

(a) a plurality of water jets carried by said rotatable member;

(b) a water pump carried by said rotatable member and communicating with said jets to supply water thereto; and (c) a water intake carried by said rotatable member and communicating with said water pump to supply water thereto.

17. An apparatus as in claim 15, wherein said rotatable member comprises:

(a) an annular envelope defining a convex-shaped exterior surface and a concave-shaped interior surface, said envelope having a peak portion and a sloping inner side meeting a sloping outer side at said peak portion, said inner side having a first predetermined curvature and said outer side having a second predetermined curvature;

(b) means for supporting said envelope, said envelope supporting means being disposed against said concave interior surface of said envelope;

(c) means for guiding rotation of said rotatable member, said rotation guiding means being disposed beneath said concave-shaped interior surface of said envelope.

18. An apparatus as in claim 17, wherein said envelope supporting means includes a rigid frame attached to said envelope.

19. An apparatus as in claim 17, wherein said means for rotating said rotatable member includes:

(a) at least one propelling wheel carried beneath said envelope;

(b) a drive gear connected to said wheel for driving same, said drive gear being carried beneath said envelope; and (c) a motor disposed beneath said envelope and connected to said drive gear for driving same.

20. An apparatus as in claim 19, further including:

means for powering said rotating means, said powering means including:

(i) a plurality of electric current carrying rails; and (ii) electric current pick-ups disposed to maintain contact with said rails and to convey electric current to said motor.

21. An apparatus as in claim 17, wherein said rotation movement guiding means includes a plurality of rotatable guide wheels disposed beneath said envelope.

22. An apparatus as in claim 15, wherein said restraining means comprises a restraint disposed generally circumferentially on said inner side of said rotatable member, said restraint defining a curved surface at one end thereof.

23. An apparatus as in claim 22, wherein said selective activation means defines a slot through said rotatable member, said restraint extending through said slot, and at least one pneumatic cylinder connected to said restraint for selectively retracting said restraint through said slot to disable said restraint and extending said restraint through said slot to restrain a passenger vehicle.

24. An apparatus as in claim 15, wherein said movement guiding means defines a guide extending above said rotatable member and having one end pointing toward said outer edge of said rotatable member.

25. An apparatus as in claim 24, wherein said speed regulating means includes:

(a) at least one rotatable surface extending at least partially above said rotatable member and disposed for engaging said passenger vehicle moving across said rotatable member, said rotatable surface being rotatable at a predetermined speed and in a predetermined direction; and (b) means for driving each said rotatable surface in said predetermined direction and at said predetermined speed.

26. An apparatus as in claim 25, wherein:

said means for driving each said rotatable surface includes a drive gear motor connected to said rotatable surface and disposed beneath said envelope.

27. An apparatus as in claim 15, wherein:

said means for depositing said passenger vehicle on said rotatable member includes a flume disposed to deposit said passenger vehicle to be carried on said rotatable member and having at least a portion of said flume inclined toward said rotatable member and having a free end.

28. An apparatus in claim 27, further comprising:

(a) means for sensing passage of a passenger vehicle exiting said free end of said flume; and (b) means for retaining said passenger vehicle from traveling down said inclined portion of said flume, said retaining means releasing the passenger vehicle in response to said deposit sensing means to permit the passenger vehicle to travel down said inclined portion of said flume.

29. An apparatus as in claim 28, further comprising:

(a) means for detecting the speed and position of said rotatable member; and (b) means for timing release of said flume retaining means so as to direct the vehicle to a predetermined location of said rotatable member, said flume release timing means communicating with said flume retaining means and said speed and position detecting means.

30. An apparatus as in claim 29, wherein:

said timing release means includes a microprocessor communicating with said speed and position detection means and with said flume retaining means.

31. An apparatus as in claim 27, wherein said receiving and returning means comprises:

(a) a channel at least partially bordering said outer edge of said rotatable member;

(b) a conveyor extending from said channel to said flume; and (c) means for imparting motion to water confined within said channel.

32. An apparatus as in claim 31, wherein:

said means for imparting motion to water confined in said channel includes at least one nozzle for dispensing a jet of water therefrom, said nozzle being disposed in said channel and directed so as to discharge any water therefrom in the same direction as the direction of rotation of said rotatable member.

33. An amusement ride simulating passage out of a whirlpool, comprising:

(a) an annular-shaped member defining a hole through a central region thereof;

(b) means for containing a pond, said hole surrounding at least a portion of said pond containing means; and (c) means for rotating said annular-shaped member.

* * * * *